US006530505B1

(12) United States Patent
Barnes et al.

(10) Patent No.: US 6,530,505 B1
(45) Date of Patent: Mar. 11, 2003

(54) DISPENSING CONTAINER WITH ROTATABLE LID

(75) Inventors: Robert Cregg Barnes, Hackettstown, NJ (US); Scott Lee Fisher, Evansville, IN (US); Donald Allan Scott, Wadesville, IN (US); David John Jochem, Evansville, IN (US); James S. Mandle, Woodcliff Lake, NJ (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 09/966,760

(22) Filed: Oct. 1, 2001

(51) Int. Cl.[7] ..... B67D 3/00
(52) U.S. Cl. ..... 222/516
(58) Field of Search ..... 222/156, 516, 222/517, 556

(56) References Cited

U.S. PATENT DOCUMENTS 1,961,173 A * 6/1934 Schutte et al. ..... 221/60
2,559,070 A * 7/1951 Goldberg ..... 222/92
3,257,037 A * 6/1966 Watson, Jr. ..... 222/96
3,369,719 A * 2/1968 Russell ..... 222/498
3,410,461 A * 11/1968 Barker ..... 222/516
3,552,608 A * 1/1971 Sperry ..... 222/516
4,805,790 A 2/1989 Leonetti et al.
5,417,350 A 5/1995 Koo
6,116,465 A * 9/2000 Bouzaglo ..... 222/92
6,206,235 B1 3/2001 Green
6,267,639 B1 7/2001 Menow et al.

* cited by examiner

*Primary Examiner*—Joseph A. Kaufman
(74) *Attorney, Agent, or Firm*—Larson & Taylor, PLC

(57) ABSTRACT

A dispensing container is formed having a housing with an opening at the top and defining an internal cavity. A wheel is rotatably attached to the housing and includes an arm which extends from the wheel and is dimensioned to cover the opening. The wheel with the extending arm is adapted to pivot away from the opening when the wheel is rotated, thereby allowing one to dispense the contents present in the container.

12 Claims, 5 Drawing Sheets

DISPENSING CONTAINER WITH ROTATABLE LID

FIELD OF THE INVENTION

The present invention relates to a container, and in particular, to a dispensing container with a rotatable lid for dispensing food products.

BACKGROUND OF THE INVENTION

Containers for packaging and dispensing food products such as candy come in a wide variety of sizes and shapes. These containers may be handheld and adapted to fit in a purse or in a pocket of a shirt or pair of pants. Further, these containers help to prevent damage to the food product contained within and to maintain its freshness. There exists a need for new and improved containers for dispensing food products such as candy.

BRIEF SUMMARY OF THE INVENTION

In accordance with a general object of the present invention, a dispensing container is provided for storing and dispensing food products such as candy wherein the dispensing container has an easy opening lid for dispensing a food product.

It is an additional object of the present invention to provide a dispensing container dimensioned to fit comfortably in the palm of a hand.

According to one aspect of the present invention, a dispensing container includes a housing defining an internal cavity and including an aperture. A wheel is rotatably attached to the housing and has an extending arm which is dimensioned to cover the aperture and to pivot away from the aperture when the wheel is rotated, thereby uncovering the aperture. In one advantageous further embodiment, the wheel is biased to cause the arm to cover the aperture.

In accordance with another aspect of the present invention, a dispensing container includes a housing having two pairs-of opposing sides, a bottom, and an opening opposite the bottom. The housing defines an internal cavity. A wheel is rotatably attached to the housing adjacent the opening and the wheel extends through one of the sides. The wheel has an extending arm and the wheel and arm are dimensioned to cover the opening. The arm is adapted to pivot away from the opening when the wheel is rotated for dispensing contents of the container. In one advantageous further embodiment, the wheel is biased to maintain the arm in a position to cover the opening.

A feature of the present invention relates to the dispensing of food product from the container by rotating the wheel and using a slight pouring action to dispense food product from the container.

An additional feature of the present invention, in one form thereof, concerns the incorporation of a biased wheel to support the arm so that it covers the opening of the container, thereby preventing food product from inadvertently being dispensed and helping to maintain the freshness of the food product within the container.

Further features and advantages of the present invention will be set forth in, or apparent from, the detailed description of preferred embodiments thereof which follows.

BRIEF DESCRIPTION OF THE DRAWINGS

The invention will now be described in detail with respect to preferred embodiments with reference to the accompanying drawings, wherein.

DETAILED DESCRIPTION OF THE INVENTION

Figure 1:
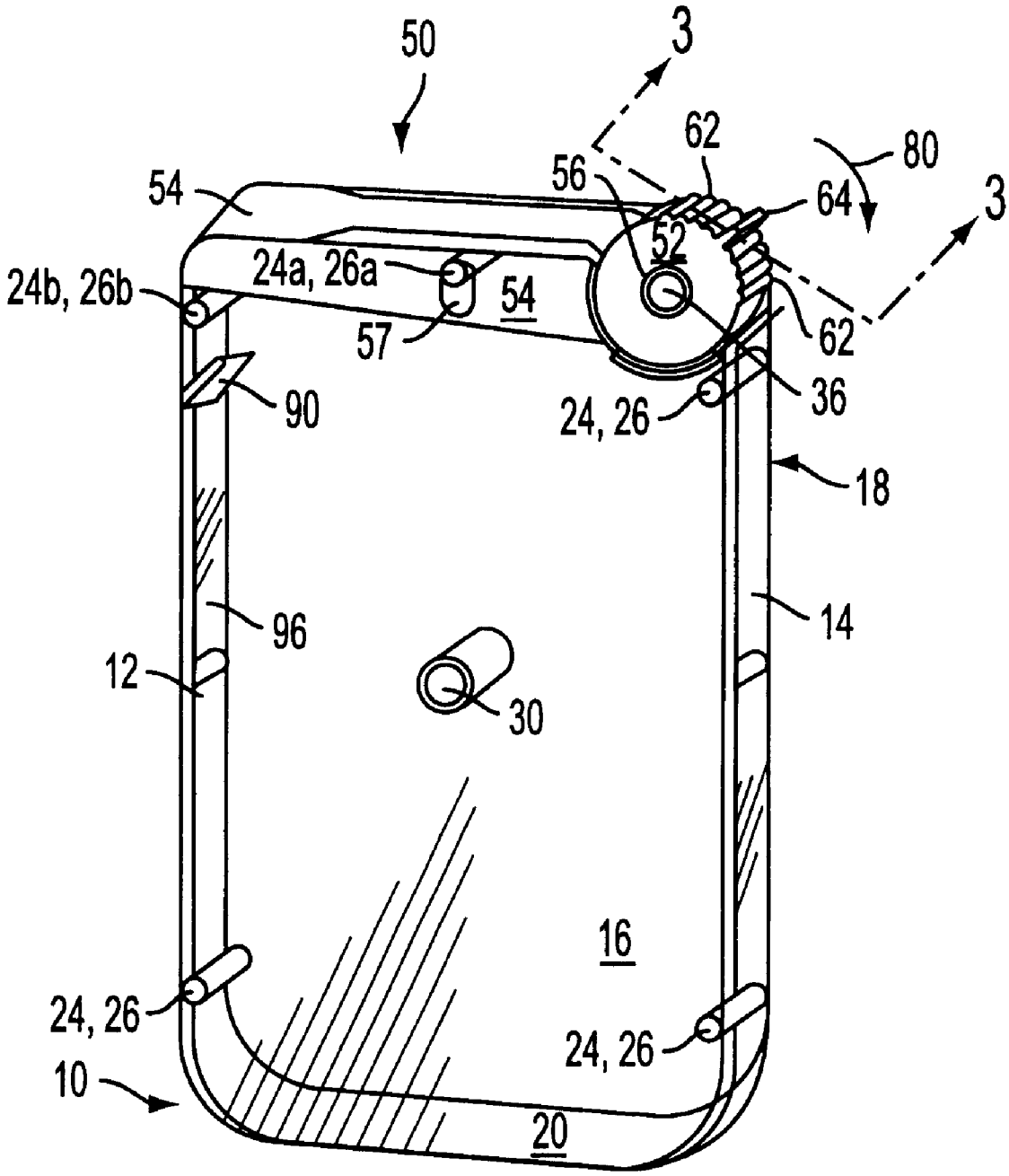
FIG. 1 is a perspective view of a dispensing container according to the present invention in a closed condition.

Referring now to the drawings, like numbers represent like elements throughout the several views. Reference numeral 10 generally identifies a dispensing container shown in a closed condition in FIGS. 1 and 3 and in an opened condition in FIGS. 2 and 4. The container 10 includes a housing having a first pair of opposing sides 12, 14 and a second pair of opposing sides 16, 18. The housing also includes a bottom 20 and an upper opening 22 opposite the bottom 20. Extending between sides 16 and 18 are mating connectors including three mating connectors 24 and 26, one set of connectors 24*a* and 26*a* and one set 24*b* and 26*b*. Support post 30 provides rigidity to sides 16 and 18. As shown, all sides of container 10 are made of transparent or translucent material. Of course such sides can also be made of opaque material.

Figure 5A:
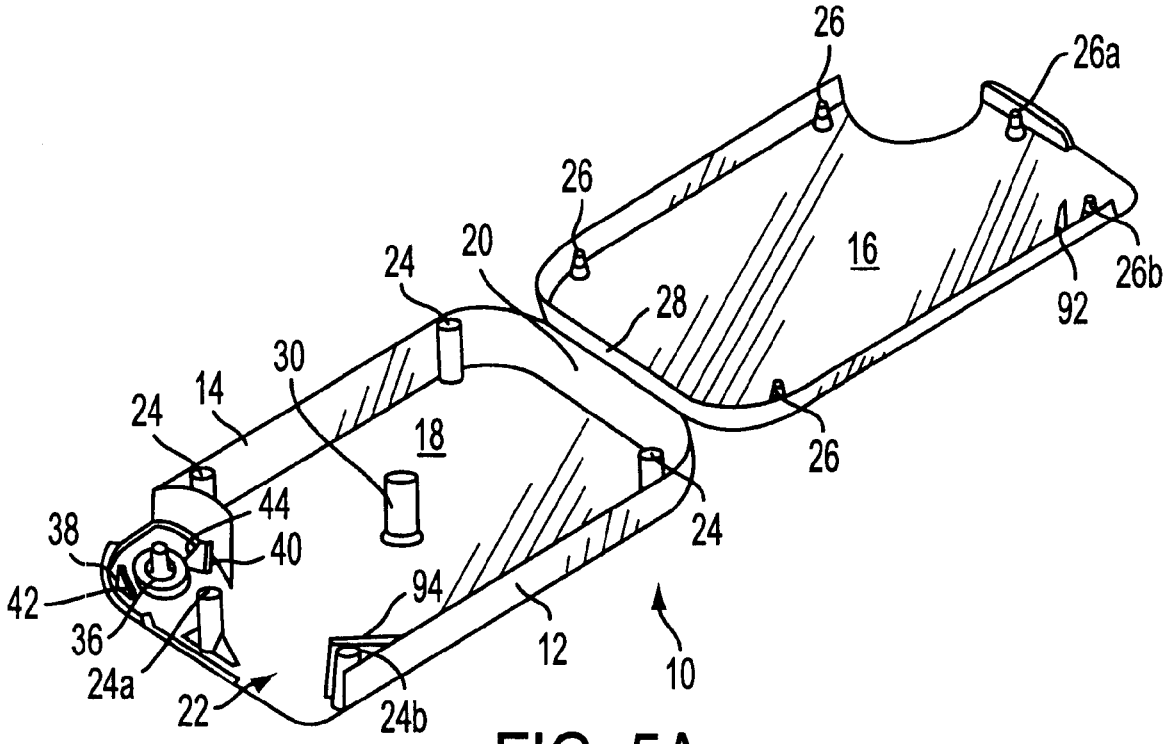
FIG. 5A is a perspective view of the main body of the dispensing container according to the present invention, shown in a disassembled condition.

Lid 50, which is dimensioned to cover opening 22, comprising a wheel portion 52 and an extending arm 54. Wheel 52 includes bore 56 and a plurality of ridges 62 which extend upwardly from the surface of wheel 52. One ridge 64 extends further from the surface of wheel 52 than the remaining plurality of ridges 62. The bore 56 is mounted on an axle 36 which is fixed to wall 18, as shown in FIG. 5A.

Figure 2:
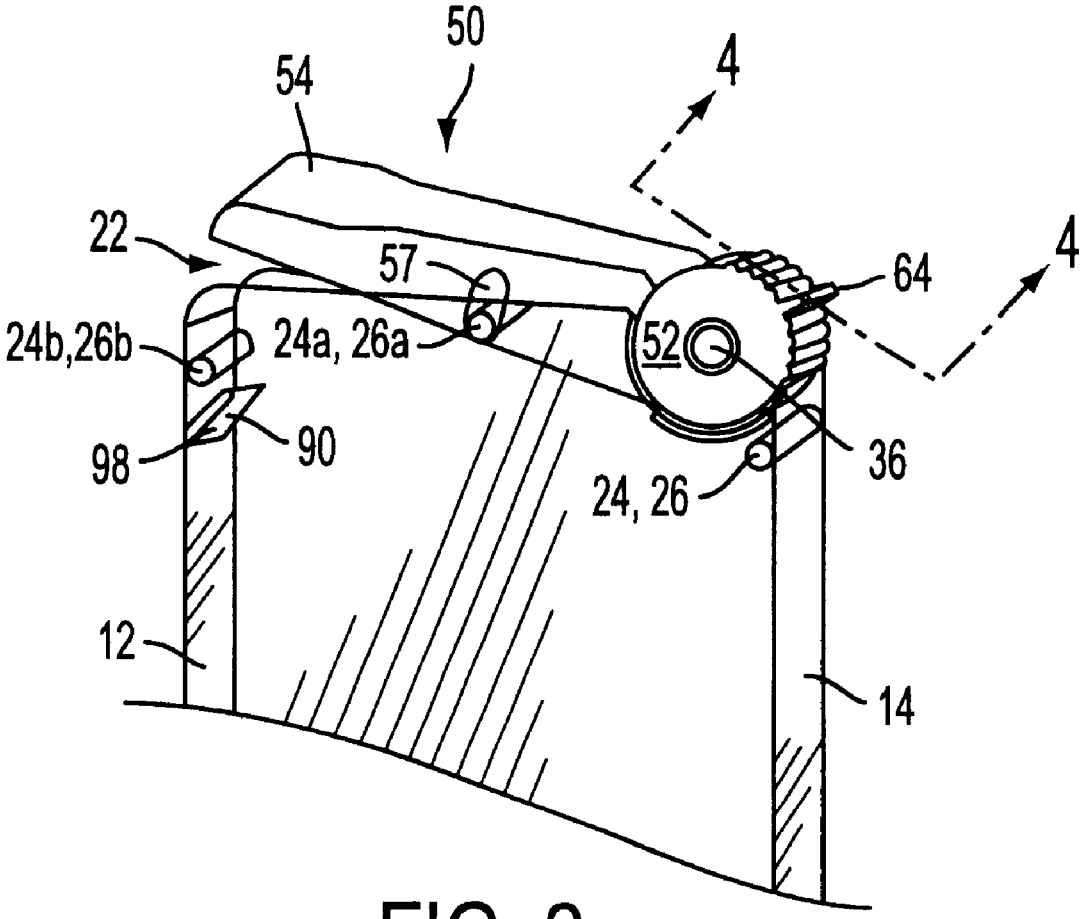
FIG. 2 is a partial perspective view of the container of FIG. 1 in an opened condition.

Lid 50 is retracted away from opening 22 by applying a rotational force to wheel 52 in the direction denoted by arrow 80. This rotational force rotates wheel 52 and in particular, bore 56 about fixed axle 36, allowing arm 54 to pivot away from opening 22 (FIG. 2). Advantageously, the plurality of ridges 62 provide a gripable surface and ridge 64 provides an additional surface to which one can apply the rotational force. Connectors 24*a*, 26*a* pass through aperture 57 in the arm 54 to provide guide and a stop to limit the angle through which wheel 52 can rotate.

Figure 3:
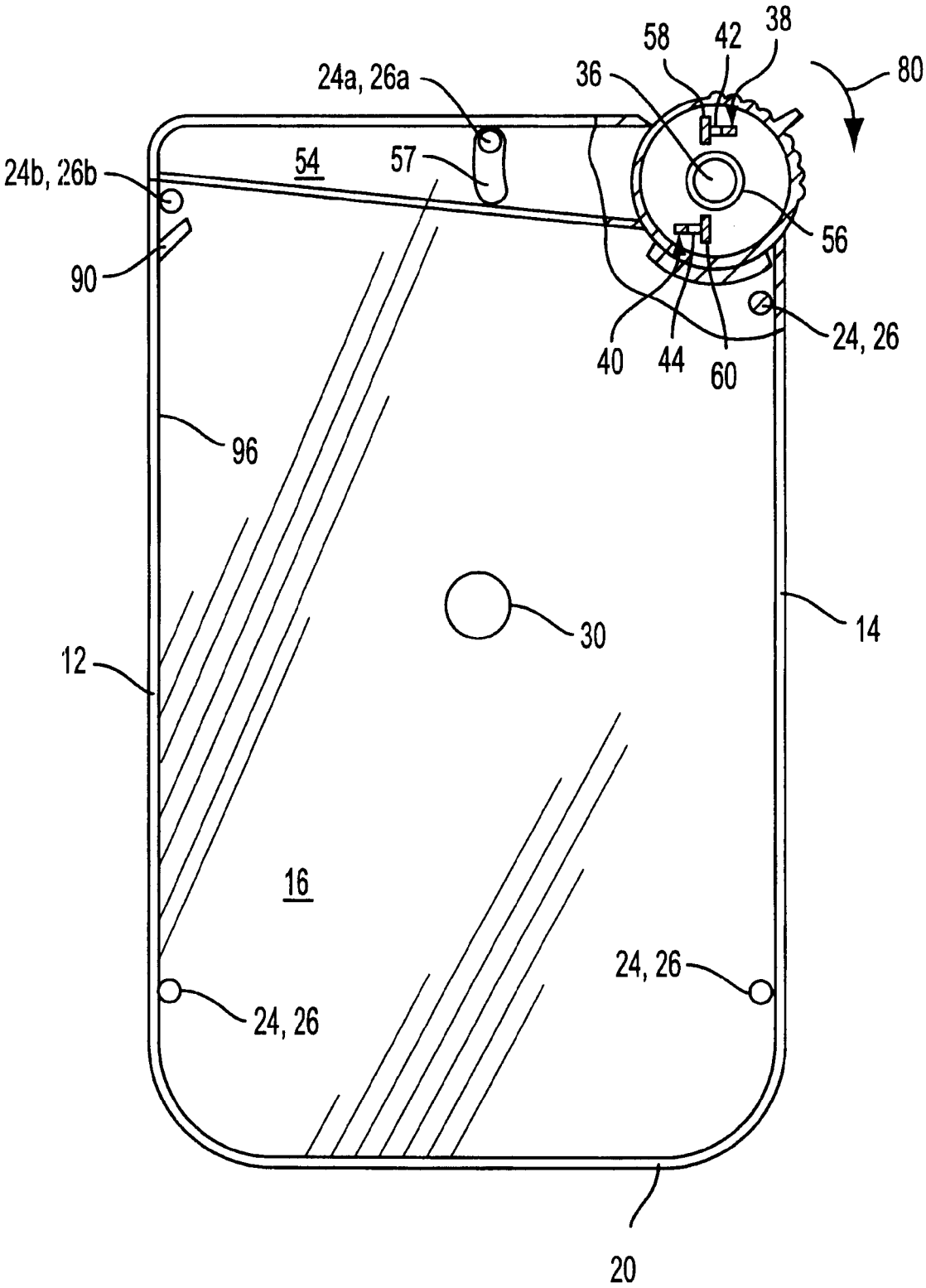
FIG. 3 is an elevational view, partially in section taken along line 3—3 of FIG. 1.
Figure 4:
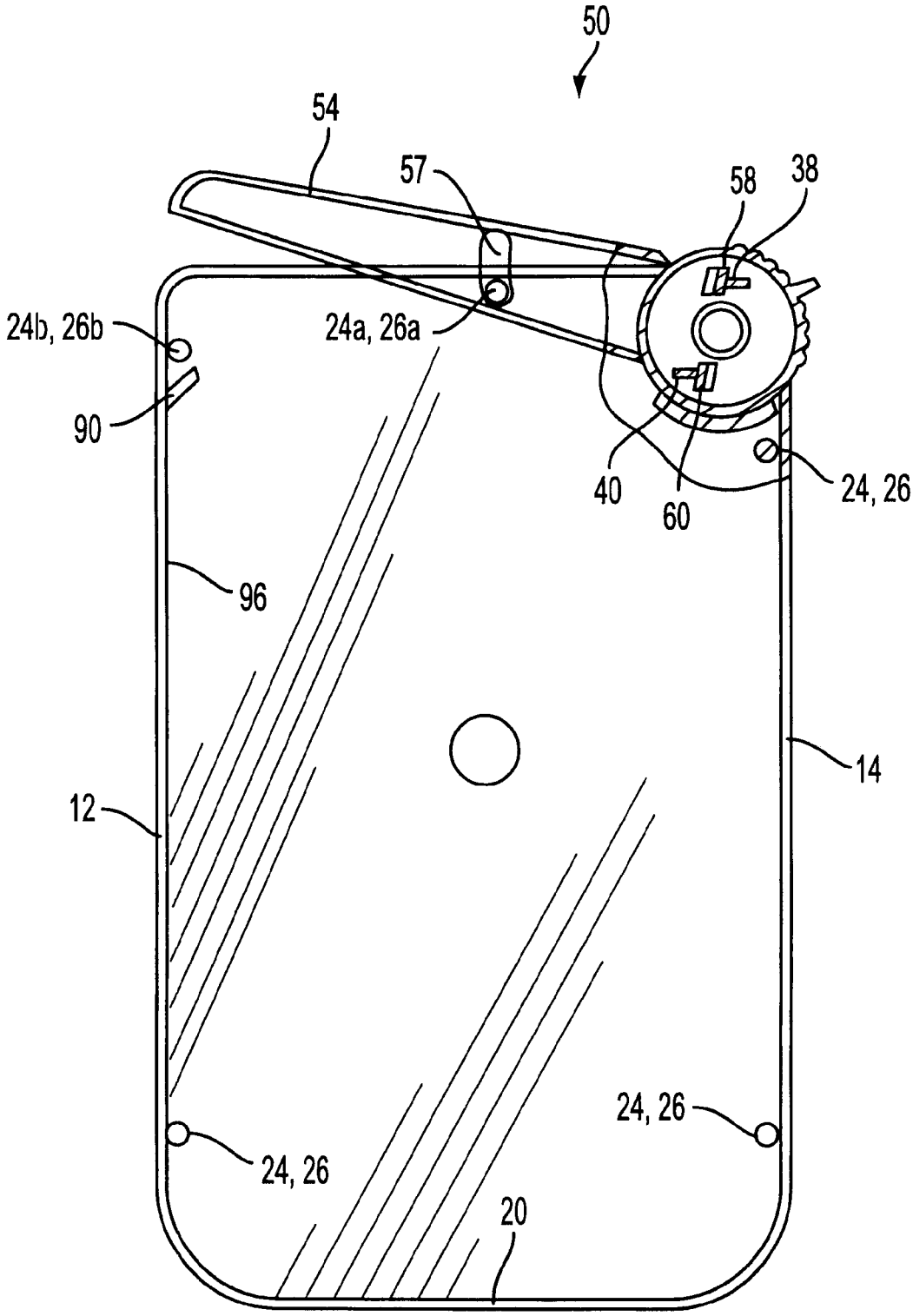
FIG. 4 is an elevational view, partially in section taken along line 4—4 of FIG. 2.

Lid 50 is biased to be maintained in a closed condition covering opening 22. The biasing of lid 50 is due to a cooperative engagement between teeth 38, 40, which are fixed to and extending from the surface of side 18, and tabs 58, 60, extending axially from wheel 52 (FIGS. 3–5). In this engagement, a portion of tab surfaces 59, 61 of tabs 58, 60 abut a portion of angled surfaces 42, 44 of teeth 38, 40 respectively. When a rotational force causes wheel 52 to rotate in direction of arrow 80 (FIG. 1), tab surfaces 59, 61 of tabs 58, 60 pivotally twist along angled surfaces 42, 44, of teeth 38, 40, respectively, resulting in the deformation of tabs 58, 60 shown in FIG. 4.

Advantageously, tabs 58, 60 are constructed of a resilient material such as polypropylene, which provides a resilient, biasing force to return tabs 58, 60 to their rest position once the rotational force is withdrawn from wheel 52. As a result, the biasing force closes lid 50 so that it covers opening 22 after the rotational force is withdrawn.

Preferably, lid 50 can be rotated by holding container 10 in the palm of one hand while applying a rotational force to ridges 62 and ridge 64 using the thumb of that hand. Food product such as candy is then dispensed into the other hand by slightly inverting or pouring the food product present in the container 10 into the other hand.

Spanning the space between side 16 and side 18 is a deflector plate 90 formed from deflector plate portions 92, 94 extending from sides 16, 18 respectively. Deflector plate 90 is angled towards opening 22 and, preferably, extends at least as far from the interior wall surface 96 of side 12 as that of connector 24*b* (best shown in FIGS. 3 and 4).

Deflector plate 90 acts to deflect food product away from connector 24*b* and towards opening 22 when the food product is dispensed. For example, during dispensing, after arm 54 is retracted from opening 22 and container 10 is tilted to permit dispensing of the food product of container 10, the food product will be deflected away from connector 24*b* by deflector plate 90, and directed toward opening 22.

Figure 5B:
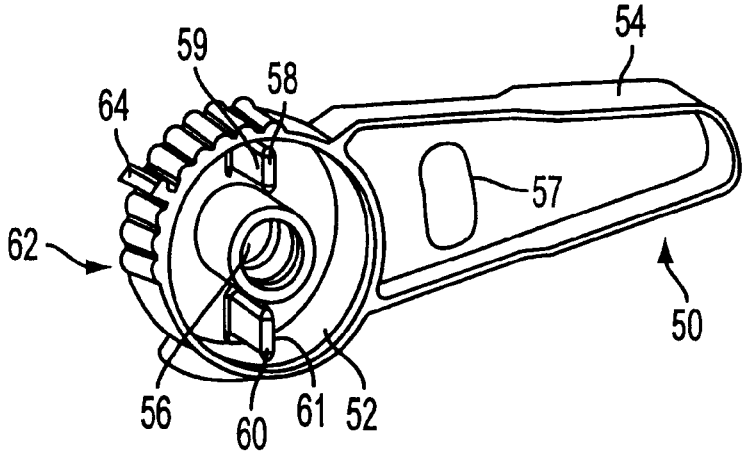
FIG. 5B is a perspective view of the lid according to the present invention.

Referring now specifically to FIGS. 5A and 5B, container 10 is assembled by first inserting bore 56 of lid 50 onto axle 36 so that tab surfaces 59, 61 of tabs 58, 60 abut angled surfaces 42, 44 of teeth 38, 40. Then, side 16 is folded along hinge 28 to align and mate connectors 24, 24*a* and 24*b* with complementary plurality of connectors 26, 26*a* and 26*b*.

It will be apparent to one of ordinary skill in the art that container 10 provides numerous features and advantages. For example, the plurality of ridges and in particular the further extending ridge 64 enables one to readily rotate the wheel 52 which then pivots arm 54 away from opening 22 for easy dispensing of food product from container 10. Further, a preferable size of container 10 provides for a dispensing container which can fit in the palm of a hand for easy dispensing of food product and which can readily be stowed in a purse or in a shirt, pants, or backpack pocket.

Although the invention has been described in detail with respect to the preferred embodiments thereof, it will be apparent to one of ordinary skilled in the art that the invention is capable of numerous modifications and variations within the scope and spirit of the invention.

What is claimed is:

1. A dispenser container comprising:

a housing having a pair of opposed sides and a pair of short opposed ends shorter than the opposed sides, said opposed sides and opposed ends forming a rectangular open top above an internal cavity capable of storing a supply of discrete solid pieces of a food product, said open top extending essentially the full length of the opposed sides, an arm extending parallel to the opposed sides completely across and closing off the entire rectangular open top, a wheel rotatably mounted on the container at the top of one of said ends with an axis of rotation perpendicular to the opposed sides, the arm being connected to the wheel at one end thereof, wherein turning of the wheel pivotally turns the arm about said axis of rotation to raise the end of the arm opposite from the wheel sufficiently to open that end of the rectangular open top to allow gravity dispensing of the food product therein upon inverting of the container.

2. The dispenser container of claim 1, wherein said wheel is biased to urge said arm to a position to cover said open top.

3. The dispenser container of claim 2, wherein said wheel is biased via a tab axially extending from said wheel cooperatively engaging with a tooth portion of said housing.

4. The dispenser container of claim 3, wherein said tab is composed of a resilient material adapted to pivotally twist about said tooth portion when said wheel is rotated, thereby establishing a biasing force.

5. The dispenser container of claim 1, wherein said wheel comprises a plurality of radially extending ridges.

6. The dispenser container of claim 5, wherein said ridges provide a gripable surface upon which a rotation force can be applied.

7. The dispenser container of claim 6, wherein one of said ridges extends radially further than the remainder of plurality of radially extending ridges, said one ridge providing an actuateable surface upon which a rotation force can be applied.

8. The dispenser container of claim 1, wherein said wheel comprises a radially extending ridge providing an actuateable surface upon which a rotation force can be applied.

9. The dispenser container of claim 1, further comprising a deflection plate extending from an inner surface of said housing adjacent said open top, said deflector plate angled towards said open top and adapted to direct contents within said container toward said open top during dispensing.

10. A dispensing container comprising:

a housing defining an internal cavity and including an aperture;

a wheel rotatably attached to said housing for rotation about a fixed axis and having a radially extending arm, said arm dimensioned to cover said aperture and to pivot away from said aperture when said wheel is rotated about said axis, thereby uncovering said aperture, wherein said wheel is biased via a tab axially extending from said wheel cooperatively engaging with a tooth portion of said housing to urge said arm to a position to cover said aperture.

11. The dispenser container of claim 10, wherein said tab is composed of a resilient material adapted to pivotally twist about said tooth portion when said wheel is rotated, thereby establishing a biasing force.

12. A dispensing container comprising:

a housing defining an internal cavity and including an aperture;

a wheel rotatably attached to said housing for rotation about a fixed axis and having a radially extending arm, said arm dimensioned to cover said aperture and to pivot away from said aperture when said wheel is rotated about said axis, thereby uncovering said aperture, and including a deflection plate extending from an inner surface of said housing adjacent said aperture, said deflector plate angled towards said aperture and adapted to direct contents within said container toward said aperture during dispensing.

* * * * *